US007982133B2

(12) United States Patent
Lincourt

(10) Patent No.: US 7,982,133 B2
(45) Date of Patent: Jul. 19, 2011

(54) CRACK CONTROLLED RESIN INSULATED ELECTRICAL COIL

(75) Inventor: Claude Lincourt, St-Jean-sur Richelieu (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 113 days.

(21) Appl. No.: 12/201,479

(22) Filed: Aug. 29, 2008

(65) Prior Publication Data

US 2010/0051317 A1 Mar. 4, 2010

(51) Int. Cl.
*H01B 7/288* (2006.01)

(52) U.S. Cl. ..... 174/122 R

(58) Field of Classification Search ..... 174/120 R, 174/122 R, 122 G, 121 R
See application file for complete search history.

(56) References Cited

U.S. PATENT DOCUMENTS

| | | | | |
|---|---|---|---|---|
| 2,387,227 | A * | 10/1945 | Bjorn et al. | 29/527.1 |
| 3,400,454 | A * | 9/1968 | Balke et al. | 29/596 |
| 3,735,168 | A | 5/1973 | Anderson et al. | |
| 3,866,316 | A | 2/1975 | Takechi et al. | |
| 3,868,613 | A | 2/1975 | Rogers, Jr. et al. | |
| 4,038,741 | A | 8/1977 | Schuler | |
| 4,204,181 | A | 5/1980 | Smith et al. | |
| 4,376,904 | A | 3/1983 | Horrigan | |
| 4,392,070 | A | 7/1983 | Zdaniewski | |
| 4,400,226 | A | 8/1983 | Horrigan | |
| 4,400,676 | A | 8/1983 | Mitsui | |
| 4,418,241 | A | 11/1983 | Fujiwara | |
| 4,818,909 | A | 4/1989 | Balke | |
| 4,890,028 | A | 12/1989 | Persson | |
| 5,140,292 | A | 8/1992 | Aronow | |
| 5,175,396 | A | 12/1992 | Emery et al. | |
| 5,416,373 | A | 5/1995 | Maruyama et al. | |
| 5,446,324 | A | 8/1995 | Onodera | |
| 6,030,713 | A | 2/2000 | Hollstein et al. | |
| 6,137,202 | A | 10/2000 | Holmes et al. | |
| 6,138,809 | A | 10/2000 | Kinoshita et al. | |
| 6,562,884 | B1 | 5/2003 | Tang et al. | |
| 6,563,413 | B1 * | 5/2003 | Ponweiser et al. | 336/186 |
| 6,657,122 | B1 * | 12/2003 | Krenzer et al. | 174/149 B |
| 6,680,119 | B2 | 1/2004 | Smith | |
| 6,797,750 | B2 | 9/2004 | Taniguchi et al. | |
| 6,933,652 | B2 | 8/2005 | Higashino et al. | |
| 6,998,753 | B2 | 2/2006 | Irwin et al. | |
| 7,081,803 | B2 | 7/2006 | Takaya et al. | |
| 2002/0067232 | A1 * | 6/2002 | Oshima et al. | 336/96 |
| 2005/0219029 | A1 * | 10/2005 | Watanabe et al. | 336/208 |

* cited by examiner

*Primary Examiner* — Chau N Nguyen
(74) *Attorney, Agent, or Firm* — Norton Rose OR LLP

(57) ABSTRACT

An electrically insulated coil assembly for use in a high vibration environment, such as with an aircraft engine, includes a coil of metal wires encompassed by a resin base matrix. A fabric is embedded in the resin matrix near an outer surface of the resin base matrix to divide a thin layer of the resin base matrix into a plurality of segments. In an embodiment, a notch blunting additive is provided in the resin to impede crack propagation.

8 Claims, 1 Drawing Sheet

CRACK CONTROLLED RESIN INSULATED ELECTRICAL COIL

TECHNICAL FIELD

The technique relates generally to insulated electrical coil assemblies and more particularly, to improved crack control for resin insulated coils.

BACKGROUND OF THE ART

It is common to encapsulate various types of electrical devices with insulating resin compositions. Numerous problems have been encountered in such practices due to the severe stresses that are often applied to the insulating resins by the operating conditions of the associated apparatus. For example, coil assemblies of aircraft accessories, such as electric motors and generators, are provided with resinous insulating materials on their coil windings. These resinous insulating materials encompass the coil wires for electrical insulation and mechanical support. However, the resinous insulating materials are frequently subjected to extensive thermal cycling, mechanical vibration and other conditions which may cause initiation of cracks in the resinous insulating materials. Over time, some of the cracks in the resinous insulation materials may develop into one or more major cracks which are prone to initiate fatigue cracking of coil wires, resulting in failure of the electric device. Efforts have been made to prevent crack occurrence in resinous insulating materials of electric coil assemblies.

However, there is still a need to provide an improved resin insulation of coil assemblies having a reduced risk of coil wire failure caused by cracks in the resin insulating materials.

SUMMARY

In one aspect the described technique provides an electrically insulated coil assembly which comprises a coil of metal wires; a resin base matrix encompassing the metal wires of at least a section of the coil for insulation and mechanical support of the coil, the resin base matrix having a thickness and thereby defining an outer surface around and radially spaced apart from the metal wires; and a fabric net embedded in the resin base matrix near the outer surface of the resin base matrix to divide a thin layer of the resin base matrix substantially over the outer surface into a plurality of segments, each of the segments being defined within one of cells of the fabric net.

In another aspect, the described technique provides an electrically insulated coil assembly for use in a high temperature, high vibration environment which comprises a coil of electrically conductive metal wires; a resin base matrix encompassing the metal wires of at least a section of the coil for insulation and mechanical support of the coil, the resin base matrix having a thickness and thereby defining an outer surface around and radially spaced apart from the metal wires, the resin base matrix having a plurality of glass beads embedded throughout the matrix; and a fabric net embedded in the resin base matrix near the outer surface of the resin base matrix to divide a thin layer of the resin base matrix substantially over the outer surface into a plurality of segments, each of the segments being defined within one of cells of the fabric net.

In a further aspect, the described technique provides a method of impeding cracks in metal wires of an electrical coil, the coil being insulated and mechanically supported by a resin base matrix encompassing the metal wires, the resin base matrix having a thickness and thereby defining an outer surface around and radially spaced apart from the metal wires, the method comprising dividing a thin layer of the resin base matrix which substantially forms the outer surface into a plurality of segments, to thereby spread and increase the number of potential crack initiating sites in the thin layer of the resin base matrix over the outer surface, resulting in generation of multiple tiny cracks in the resin base matrix in preference to larger cracking of the type prone to initiate fatigue cracking of the metal wires Further details of these and other aspects will be apparent from the detailed description and figures included below.

DESCRIPTION OF THE DRAWINGS

Reference is now made to the accompanying figures depicting aspects of the described technique, in which.

DETAILED DESCRIPTION OF THE PREFERRED EMBODIMENTS

Figure 2:
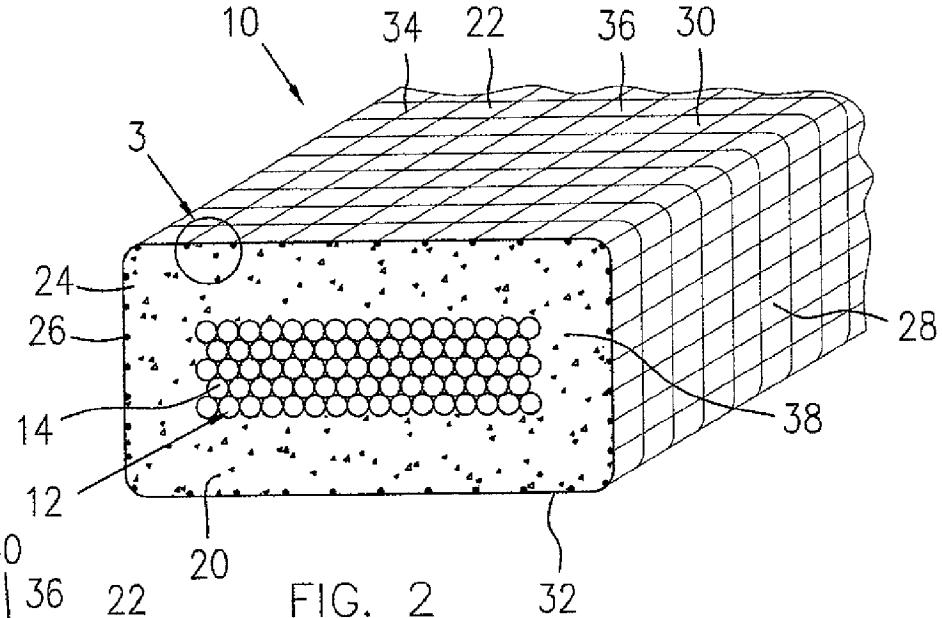
FIG. 2 is an enlarged partial perspective view of the electrically insulated coil assembly of FIG. 1, showing a cross-section thereof taken along line 2-2.
Figure 1:
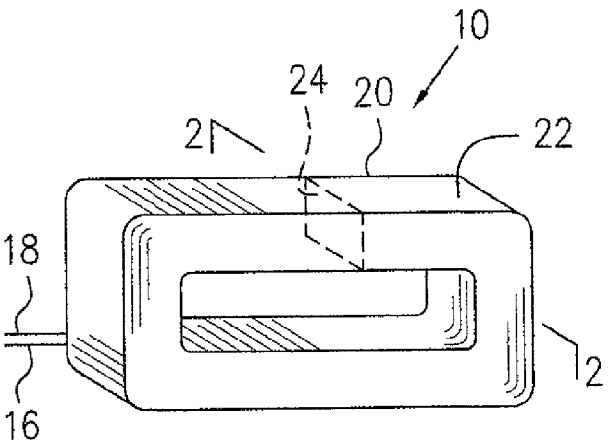
FIG. 1 is a perspective view of an electrically insulated coil assembly according to one embodiment in which wire windings are substantially encompassed by a resin base matrix.

Referring now to the drawings, particularly to FIGS. 1 and 2, there is illustrated an electrically insulated coil assembly generally indicated by numeral 10 which may be used for example, in any electric device for aircraft accessories, such as electric motors, generators, alternators, etc. The coil assembly 10 includes a coil 12 of electrically conductive metal wires 14 such as copper wires. The metal wires have an outer layer of insulation such that the metal wires 14 are insulated from adjacent turns of the coil 12. The coil 12 has at least two connection ends 16, 18 for electrical connection with a circuit of the electric device (not shown) in which the coil assembly 10 is used.

The coil assembly 10 further includes a resin base matrix, for example an epoxy base matrix 20 which encompasses the metal wires 14 of at least a section of the coil 12 (the coil 12 is completely encompassed by the epoxy base matrix 20 in this embodiment except for the connection ends 16, 18, as illustrated) for insulation and mechanical support of the coil 12. The epoxy base matrix 20 which surrounds the metal wires 14 has a thickness to thereby define an outer surface 22 around and radially spaced apart from the metal wires 14. It is noted that the outer surface 22 is defined by a complete circumference of the epoxy base matrix 20 around the metal wires 14 substantially parallel in that section of the coil 12. In this embodiment, the epoxy base matrix 20 has a cross-section 24 substantially defining a rectangular outline of the above-mentioned complete circumference. Therefore, the outer surface 22 is defined by the complete rectangular circumference of the epoxy base matrix 20 including surfaces on opposite sides 26, 28 of the epoxy base matrix 20 and on a top surface 30 and bottom surface 32 of the epoxy base matrix 20, as illustrated in FIG. 2.

In use, cracks may develop in the epoxy base matrix 20 due, for example, to vibration and/or thermal expansion variations between metal wires 14 and the surrounding epoxy material of the epoxy base matrix 20. Such cracks if allowed to develop, may further propagate within the body of the epoxy base matrix 20 to result in one or more major cracks which would not only adversely affect the mechanical support of the epoxy base matrix 20 to the coil 12 but are prone to initiate fatigue cracking of the metal wires 14 of the coil 12, thereby causing electrical failure of the coil 12.

In contrast to the prior art, in which measurements are taken to prevent or reduce the risk of initiation of cracks in the epoxy base matrix or other resin base matrix of electrical coil assemblies, an embodiment of the presently described technique facilitates the initiation of tiny cracks in the epoxy base matrix 20 and to further control and prevent development and propagation of the tiny cracks in the epoxy base matrix 20.

As shown in FIG. 2, a fabric, for example a glass mesh fabric 34, referred to herein as a glass fabric net 34, is embedded in the epoxy base matrix 20 near the outer surface 22 of the epoxy base matrix 20, to divide a thin layer 21 (see FIG. 3) of the epoxy base matrix 20 substantially over the entire outer surface 22, into a plurality of segments 36, each of the segments 36 being defined within of cells (not indicated) of the glass fabric net 34. In this example, the glass fabric net 34 may be formed by a first group of glass fibres (not indicated) substantially parallel to the metal wires 14 and a second group of glass fibres (not indicated) substantially transverse to the metal wires 14, thereby defining the cells substantially in a square shape.

It is noted that the epoxy base matrix 20 is not simply wrapped over by the glass fabric net 34, but rather the glass fabric net 34 is embedded in the epoxy base matrix 20. Therefore, the fibres of the glass fabric net 34 physically divide the thin layer 21 of the epoxy base matrix 20, which substantially defines the entire outer surface 22. It is noted that the thin layer 21 is an integral part of the base matrix 20, and is thus not physically separate from the base matrix 20.

The epoxy base matrix 20 may further include a means for creating discontinuity of the epoxy material in a thick body thereof radially located between the metal wires 14 and the thin layer 21 of the epoxy material in which the glass fabric net 34 is embedded. For example, a filler material such as a plurality of glass beads 38 may be embedded in the thick body of the epoxy base matrix 20, substantially spreading throughout the entire thickness of the epoxy base matrix 20. In use, the embedded glass fabric net 34 increases the number of potential crack initiation sites in the epoxy material near and over the outer surface 22, resulting in the redistribution, over the multiple crack sites, the compliance or strain causing cracking of the epoxy material due to heat expansion, and/or vibration etc. Therefore, this results in the generation of multiple tiny cracks in the epoxy material, instead of one or more major cracks, which smaller cracks will tend not to cause significant damage to the metal wires 14 of the coil 12. The presence of the beads provides a notch blunting effect on the tiny cracks, which has a net effect of increasing the toughness of the epoxy base matrix 20 and reducing the thermal expansion mismatch between the epoxy material and the copper wires 14, which may also reduce the risk of crack occurrence in the epoxy base matrix 20.

Figure 3:
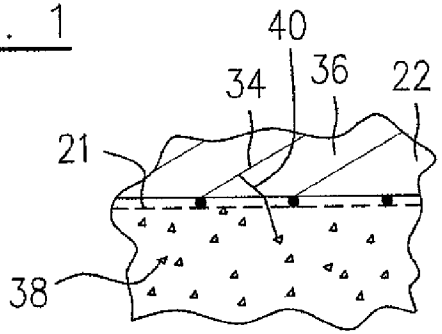
FIG. 3 is an enlarged view of portion of the resin base matrix indicated by numeral 3 in FIG. 2, illustrating an embedded fabric net and fillers in the resin base matrix for controlling development of cracks in the resin base matrix.

As shown in FIG. 3, the segments 36 defined by the cells of the glass fabric net 34 impede a tiny crack indicated by numeral 40 from development and propagation within the thin layer along the outer surface 22. The epoxy material in the thin layer near the outer surface 22 is discontinued by the glass fibres of the glass fabric net 34 and therefore the development and propagation of the crack 40 in the thin layer of the epoxy material near the outer surface 22 is stopped by the adjacent glass fibres of the glass fabric net 34. When the crack 40 develops and propagates inwardly into the thick body of the epoxy base matrix 20, such development and propagation of crack 40 will also be stopped by the epoxy material discontinuity created by the filler of glass beads 38. The glass beads 38 are randomly spread throughout the entire thickness of the epoxy base matrix 20, therefore crack 40 is stopped before developing and propagating into a depth of the thickness of the epoxy base matrix 20.

The electrically insulated coil assembly 20 has increased capability at relatively high operation temperatures and has a longer life span.

The size of the cells of the glass fabric net 34, and the size and density of glass beads 38, depend on the parameters of the particular design, as the skilled reader will appreciate. The above description is meant to be exemplary only, and one skilled in the art will recognize that changes may be made to the embodiments described without departure from the scope of the above-described technique. For example, other suitable types of resin materials, other than epoxy base resin, may be used for the insulation matrix of an electrical coil. Other suitable fabric nets instead of glass fabric net and/or a net having square cells may also be applicable to this technique. The principle of the described technique may be applied to an electrical coil of any metal wires other than copper, or to electrical coils of any physical configuration different from the embodiment described herein. Still other modifications which fall within the scope of the above-described technique may be apparent to those skilled in the art, in light of a review of this disclosure, and such modifications are intended to fall within the appended claims.

The invention claimed is:

1. An electrically insulated coil assembly, comprising:

a coil of metal wires having a plurality of leads;

a resin base matrix of a loop encompassing the metal wires of an entire portion of the coil except for the leads, for insulation and mechanical support of the coil, the resin base matrix having a thickness and thereby defining an outer surface around and radially spaced apart from the metal wires; and a fabric net embedded in the resin base matrix near the outer surface of the resin base matrix to divide a thin layer of the resin base matrix substantially over the outer surface into a plurality of segments, each of the segments being defined within one of cells of the fabric net.

2. The coil assembly as defined in claim 1, wherein the resin comprises an epoxy resin.

3. The coil assembly as defined in claim 1, wherein the fabric net is a glass fabric net.

4. The coil assembly as defined in claim 3, wherein the glass fabric net comprises a first group of glass fibres substantially parallel to the metal wires and a second group of glass fibres substantially transverse to the metal wires, thereby defining the cells substantially in a square shape.

5. The coil assembly as defined in claim 1, wherein the resin base matrix comprises a means for creating material discontinuity in a body of the resin base matrix, radially between the metal wires and the fabric net.

6. The coil assembly as defined in claim 5 wherein the means comprises a filler material.

7. The coil assembly as defined in claim 6 wherein the filler material comprises a plurality of glass beads.

8. An electrically insulated coil assembly for use in a high temperature, high vibration environment, the assembly comprising:

a coil of electrically conductive metal wires having a plurality of leads;

a resin base matrix of a loop encompassing the metal wires of an entire portion of the coil except for the leads, for insulation and mechanical support of the coil, the resin base matrix having a thickness and thereby defining an outer surface around and radially spaced apart from the metal wires, the resin base matrix having a plurality of glass beads embedded throughout the matrix; and a fabric net embedded in the resin base matrix near the outer surface of the resin base matrix to divide a thin layer of the resin base matrix substantially over the outer surface into a plurality of segments, each of the segments being defined within one of cells of the fabric net.

* * * * *